US012590539B2

(12) United States Patent
Mahavadi et al.

(10) Patent No.: US 12,590,539 B2
(45) Date of Patent: Mar. 31, 2026

(54) SYSTEMS AND METHODS FOR ANALYSIS OF DRILLING FLUID

(71) Applicant: Schlumberger Technology Corporation, Sugar Land, TX (US)

(72) Inventors: Sharath Chandra Mahavadi, Lexington, MA (US); Ling Feng, Belmont, MA (US); Balakrishnan Panamarathupalayam, Houston, TX (US); Dimitri Khramov, Katy, TX (US); Lucas Mejia, Austin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1017 days.

(21) Appl. No.: 17/654,692

(22) Filed: Mar. 14, 2022

(65) Prior Publication Data

US 2023/0287789 A1 Sep. 14, 2023

(51) Int. Cl.
*E21B 49/08* (2006.01)

(52) U.S. Cl.
CPC ..... *E21B 49/088* (2013.01); *E21B 2200/20* (2020.05)

(58) Field of Classification Search
CPC .... G01N 27/26; G01N 27/416; G01N 27/447; G01N 27/44713; G01N 27/44743; G01N 27/44756; G01N 27/44769; G01N 27/44773; G01N 33/2823; E21B 21/01; E21B 2200/20; E21B 49/088
See application file for complete search history.

(56) References Cited

U.S. PATENT DOCUMENTS

| | | | |
|---|---|---|---|
| 4,291,001 | A | 9/1981 | Repsher |
| 4,727,936 | A | 3/1988 | Mioduszewski |
| 5,681,477 | A | 10/1997 | Leavitt |
| 5,833,844 | A | 11/1998 | Leavitt |
| 6,073,448 | A | 6/2000 | Lozada |
| 6,670,605 | B1 | 12/2003 | Storm, Jr. |
| 9,068,247 | B2 | 6/2015 | Marston |
| 9,976,417 | B2 | 5/2018 | Mahavadi |
| 10,018,590 | B2 | 7/2018 | Mahavadi |
| 11,169,114 | B2 | 11/2021 | Mahavadi |

(Continued)

FOREIGN PATENT DOCUMENTS

| | | | |
|---|---|---|---|
| CN | 1511964 | A | 7/2004 |
| CN | 104313348 | A | 1/2015 |

(Continued)

OTHER PUBLICATIONS

Refrigeration, https://energyrecovery.com/refrigeration/, downloaded on Aug. 14, 2021 (5 pages).

(Continued)

*Primary Examiner* — Gurpreet Kaur
(74) *Attorney, Agent, or Firm* — Jeffrey D. Frantz

(57) ABSTRACT

A method of operating a drilling fluid analysis system includes obtaining multiple samples of a drilling fluid at different times over a time period. The method also includes placing the multiple samples into a capillary electrophoresis device. The method further includes determining a respective concentration of a component in each of the multiple samples of the drilling fluid with the capillary electrophoresis device.

10 Claims, 9 Drawing Sheets

(56) References Cited

U.S. PATENT DOCUMENTS

| | | | | |
|---|---|---|---|---|
| 11,298,658 | B2 | 4/2022 | Wohlert | |
| 11,365,128 | B2 | 6/2022 | Marston | |
| 11,941,128 | B2 | 3/2024 | Andersen | |
| 2003/0132113 | A1 | 7/2003 | Sarme | |
| 2006/0163069 | A1 | 7/2006 | Prak | |
| 2009/0269767 | A1 | 10/2009 | Soderlund | |
| 2010/0068605 | A1 | 3/2010 | Harris | |
| 2011/0174739 | A1 | 7/2011 | Chung | |
| 2012/0103826 | A1 | 5/2012 | Gordon | |
| 2013/0205778 | A1 | 8/2013 | Hansen | |
| 2014/0048485 | A1 | 2/2014 | Jacobs | |
| 2014/0076734 | A1 | 3/2014 | Calvo | |
| 2014/0239224 | A1 | 8/2014 | Burba | |
| 2015/0114837 | A1 | 4/2015 | Mahavadi | |
| 2015/0197830 | A1 | 7/2015 | Chon | |
| 2016/0221833 | A1 | 8/2016 | Zhu | |
| 2017/0045476 | A1 | 2/2017 | Mahavadi | |
| 2017/0102370 | A1 | 4/2017 | Alber | |
| 2017/0175228 | A1 | 6/2017 | Hunwick | |
| 2018/0016153 | A1 | 1/2018 | Sharma | |
| 2018/0147532 | A1 | 5/2018 | Switzer | |
| 2018/0207584 | A1 | 7/2018 | Chang | |
| 2018/0245180 | A1 | 8/2018 | Cheng | |
| 2019/0120791 | A1 | 4/2019 | Al-Gouhi | |
| 2019/0226336 | A1 | 7/2019 | Benson | |
| 2019/0248667 | A1 | 8/2019 | Featherstone | |
| 2019/0256368 | A1 | 8/2019 | Marston | |
| 2020/0047124 | A1 | 2/2020 | Bhave | |
| 2020/0086271 | A1 | 3/2020 | Harrison | |
| 2020/0299805 | A1 | 9/2020 | Mceachern | |
| 2020/0316557 | A1 | 10/2020 | Boualleg | |
| 2021/0086400 | A1 | 3/2021 | Andersen | |
| 2022/0055910 | A1 | 2/2022 | Jariwala | |
| 2023/0032153 | A1 | 2/2023 | Sams | |
| 2023/0086861 | A1 | 3/2023 | Perroni | |
| 2023/0088458 | A1 | 3/2023 | Sams | |
| 2023/0125398 | A1* | 4/2023 | Abdelaal | E21B 45/00 175/24 |
| 2024/0308865 | A1 | 9/2024 | Perroni | |

FOREIGN PATENT DOCUMENTS

| | | | |
|---|---|---|---|
| CN | 111635998 | B | 7/2021 |
| JP | 2011032151 | A | 2/2011 |
| JP | 2018172775 | A | 11/2018 |
| JP | 2021017627 | A | 2/2021 |
| NO | 345901 | B1 | 10/2021 |
| RU | 2688593 | C1 | 5/2019 |
| WO | 2006103312 | A1 | 10/2006 |
| WO | 2009137834 | A2 | 11/2009 |
| WO | 2012044163 | A1 | 4/2012 |
| WO | 2015023917 | A1 | 2/2015 |
| WO | 2018081506 | A1 | 5/2018 |
| WO | 2018183555 | A1 | 10/2018 |
| WO | 2018190754 | A2 | 10/2018 |
| WO | 2019160982 | A1 | 8/2019 |
| WO | 2019221932 | A1 | 11/2019 |
| WO | 2022040630 | A1 | 2/2022 |
| WO | 2022203706 | A1 | 9/2022 |
| WO | 2023009887 | A1 | 2/2023 |
| WO | 2023009888 | A1 | 2/2023 |
| WO | 2023022627 | A1 | 2/2023 |
| WO | 2023183546 | A1 | 9/2023 |

OTHER PUBLICATIONS

Ferrara et al., (2015) A Small Power recovery expander for heat pump COP improvement, Energy Procedia 81 (015) 1151-1159.

Turbomachine expander offers efficient, safe strategy for heating, cooling, https://www.purdue.edu/newsroom/releases/2020/Q1/turbomachine-expander-offers-efficient,-safe-strategy-for-heating,-cooling.html, downloaded on Aug. 15, 2021 (5 pages).

Turkia, et al., Online Capillary Electophoresis for Monitoring Carboxylic Acid Production by Yeast during Bioreactor Cultivations, Anal. Chem. 2013, 85, 9705-97.

Search Report and Written Opinion issued in the PCT Application No. PCT/US2023/063834 dated Jun. 29, 2023, 10 pages.

International Search Report and Written Opinion issued in the PCT Application No. PCT/US2024/044617 dated Nov. 27, 2024, 13 pages.

International Search Report and Written Opinion issued in the PCT Application No. PCT/US2022/039015 dated Dec. 19, 2022, 13 pages.

Notice of Allowance issued in U.S. Appl. No. 18/293,532 dated Nov. 27, 2024, 17 pages.

International Search Report and Written Opinion of the PCT Application No. PCT/US2022/039021 dated Nov. 7, 2022, 13 pages.

International Search Report and Written Opinion issued in the PCT Application No. PCT/US2021/047156 dated Nov. 25, 2021, 11 pages.

Office Action issued in U.S. Appl. No. 17/444,072 dated Jul. 31, 2024, 23 pages.

Written Opinion issued in Chilean Patent Application No. 202300507 dated Aug. 21, 2024, 23 pages with English translation.

Office Action issued in U.S. Appl. No. 17/815,593 dated Sep. 4, 2024, 9 pages.

Office Action issued in U.S. Appl. No. 18/052,647 dated Sep. 9, 2024, 10 pages.

Office Action issued in U.S. Appl. No. 18/060,735 dated Jun. 17, 2024, 12 pages.

Excedr, "Capillary Electrophoresis: Overview & Applications", last updated on May 4, 2023, downloaded from https://www.excedr.com/resources/capillary-electrophoresis-overview, 2023, 12 pages.

Renew, J. et al., "Geothermal Thermoelectric Generation (G-TEG) with Integrated Temperature Driven Membrane Distillation and Novel Manganese Oxide for Lithium Extraction", DE-EE-0006746, United States, 2017, 52 pages.

Toba, A.-L. et al., "U.S. lithium resources from geothermal an extraction feasibility", Resources, Conseration & Recycling, 2021, 169, 13 pages.

Culter, G, "Drilling and Well Constructions", Chapter 6 in Geothermal Direct Use in Engineering and Design Guidebook, Paul Lienau and Ben Lunis editors, Geo-Heat Center, Oregon Institute of Technology, Klamath Falls Oregon 97601, Published—March 1889, 36 pages.

"Geothermal Energy Abstract Sets", Special Report No. 14, Published by Geothermal Resources Council, Under Grant No. DE-FG03-F11718 United States Department of Energy, Compiled and Edited by Claudia Stone, 1984-1985, 139 pages.

Finger, J. et al., "Handbook of Best Practices for Geothermal Drilling", Sandia Report SAND2010-6048, Unlimited Release, Printed Dec. 2010, 84 pages.

Stringfellow, W. T. et al., "Technology for the Recovery of Lithium from Geothermal Brines", Energies, 2021, 14, 72 pages.

Ross, P. et al., "Salton Sea Scientific Drilling Project—A summery of Drilling and Engineering Activities and Scientific Resulta", Final Report, Apr. 1992, The University of Utah Research Institute, 1992, 237 pages.

Warren, I., Techno-Economic Analysis of Lithium Extraction from Geothermal Brines, downloaded on Sep. 2, 2024 from [https://www.nrel.gov/docs/fy21osti/79178.pdf], 2021, 48 pages.

Science Direct, (Sep. 3, 2025), AI-generated definition of "Stimulation Fluid" by Science Direct AI search [Large language model], downloaded from the internet at https://www.sciencedirect.com/topics/engineering/stimulation-fluid, 11 pages.

* cited by examiner

158

| 2a: FORMULATION OF MUD | |
|---|---|
| BRINE | 301.58 |
| SHALE INHIBITOR | 0.00 |
| SHALE ENCAPSULATOR | 1.00 |
| FLUID LOSS CONTROL | 2.00 |
| VISCOSIFIER | 1.00 |
| LUBRICANT | 7.00 |
| CLAY (CONTAMINATION) | 25.00 |
| WEIGHTING AGENT | 120.00 |
| 1.25 ppb SODA ASH FOR BUFFER AND pH | |

150

| 2b: RHEOLOGY, 3 SCENARIOS | 152 | 154 | 156 |
|---|---|---|---|
| | CONTROL | INHIBITOR AFTER CLAY | INHIBITOR BEFORE CLAY |
| RHEOLOGY TEMP, °F | 120 | 120 | 120 |
| R600, °VG | 247.4 | 328.2 | 66 |
| R300, °VG | 174.5 | 267.9 | 45 |
| R200, °VG | 142.3 | 230.9 | 35 |
| R100, °VG | 103 | 191.5 | 24 |
| R6, °VG | 37.5 | 155.9 | 7.3 |
| R3, °VG | 33 | 168.1 | 6 |
| PV, cP | 73 | 60 | 21 |
| YP, lb / 100ft$^2$ | 102 | 208 | 24 |
| LSYP, lb / 100ft$^2$ | 29 | 180 | 5 |
| 10-sec Gel, lb / 100ft$^2$ | 41.7 | 125.8 | 7 |
| 10-min Gel, lb / 100ft$^2$ | 91 | 122.3 | 8 |

FIG. 5

166

| 3a: FORMULATION OF MUD | |
|---|---|
| BRINE | 301.58 |
| SHALE INHIBITOR | 0.00 |
| SHALE ENCAPSULATOR | 1.00 |
| FLUID LOSS CONTROL | 2.00 |
| VISCOSIFIER | 1.00 |
| LUBRICANT | 7.00 |
| API EVALUATION CLAY | 40.00 |
| WEIGHTING AGENT | 109.6 |

160

| 3b: RHEOLOGY, 2 SCENARIOS | 162 | 164 |
|---|---|---|
| | CONTROL | INHIBITOR AFTER CLAY |
| RHEOLOGY TEMP, °F | 120 | 120 |
| R600, °VG | 107.8 | 101.8 |
| R300, °VG | 77.4 | 75.2 |
| R200, °VG | 56.8 | 56.8 |
| R100, °VG | 37.3 | 39.7 |
| R6, °VG | 11.1 | 13 |
| R3, °VG | 8.6 | 11.1 |
| PV, cP | 30 | 27 |
| YP, lb /100ft$^2$ | 47 | 49 |
| LSYP, lb /100ft$^2$ | 6 | 9 |
| 10–sec Gel, lb /100ft$^2$ | 10.6 | 11.1 |
| 10–min Gel, lb /100ft$^2$ | 15.7 | 18 |

FIG. 6

SYSTEMS AND METHODS FOR ANALYSIS OF DRILLING FLUID

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Natural resources, such as oil and gas, are used as fuel to power vehicles, heat homes, and generate electricity, in addition to various other uses. Once a desired resource is discovered below the surface of the earth, drilling systems are often employed to access the desired resource and production systems are often employed to extract the desired resource. These drilling systems and/or production systems may be located onshore or offshore depending on the location of the desired resource. Further, such drilling systems and/or production systems may include a wide variety of components, such as casings, fluid conduits, valves, pumps, and the like. For example, a drilling system may include a pump that operates to pump drilling fluid (e.g., drilling mud) from a surface tank into a wellbore during drilling operations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a method of operating a drilling fluid analysis system includes obtaining multiple samples of a drilling fluid at different times over a time period. The method also includes placing the multiple samples into a capillary electrophoresis device. The method further includes determining a respective concentration of a component in each of the multiple samples of the drilling fluid with the capillary electrophoresis device In one embodiment, a drilling fluid analysis system includes a capillary electrophoresis device configured to perform one or more tests on one or more samples of a drilling fluid. The drilling fluid analysis system also includes one or more processors configured to analyze results of the one or more tests to determine a characteristic of the subterranean formation and to provide an output based on the characteristic of the subterranean formation.

In one embodiment, a drilling system includes a drill string, a drilling fluid tank, and a pump configured to pump a drilling fluid from the drilling fluid tank into the drill string. The drilling system also includes a drilling fluid analysis system configured to obtain a sample of the drilling fluid, and the drilling fluid analysis system includes a capillary electrophoresis device configured to perform a test on the sample of the drilling fluid. The drilling fluid analysis system also includes one or more processors configured to analyze results of the test to determine a concentration of a component in the sample of the drilling fluid.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 5 illustrates an examples of a table that shows variations in rheology of a drilling fluid based on a time of addition of an inhibitor to the drilling fluid, in accordance with an embodiment of the present disclosure;

FIG. 6 illustrates an example of a table that shows a rheology of a drilling fluid after addition of an inhibitor and with a non-reactive clay, in accordance with an embodiment of the present disclosure;

DETAILED DESCRIPTION

Figure 1:
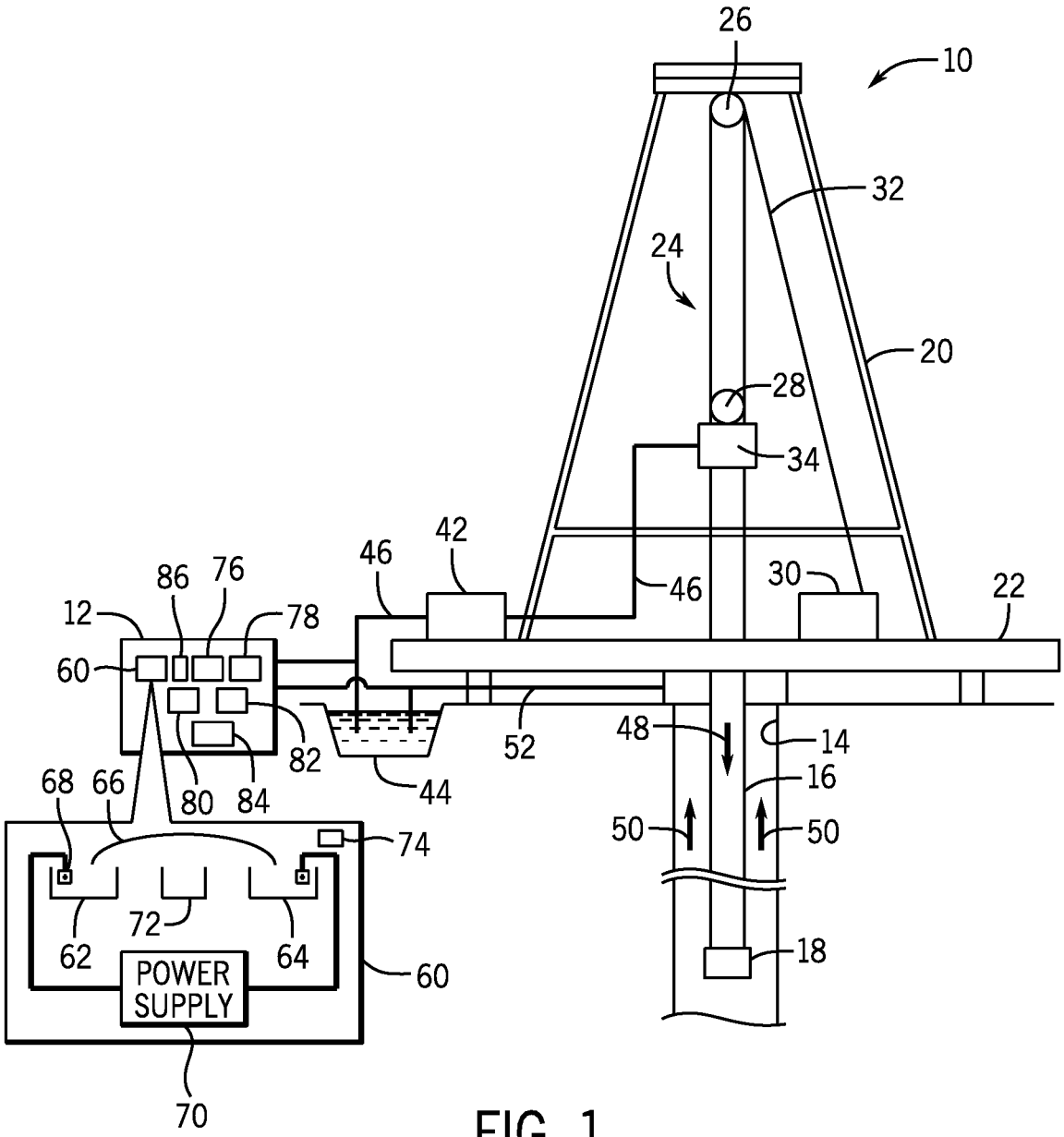
FIG. 1 is a schematic diagram of a drilling system with a drilling fluid analysis system, in accordance with an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A drilling system may carry out drilling operations to form a wellbore within or into a subterranean formation to recover hydrocarbons trapped within the subterranean formation. During drilling operations, drilling fluid (e.g., drilling mud) flows through a drill string, out a drill bit at a distal end of the drill string, and then upward through an annular passage between the drill string and a wall of the wellbore. The drilling fluid is generally used for lubrication and cooling of cutting surfaces of the drill bit while drilling generally or drilling-in (e.g., drilling in a targeted petroliferous formation), for transportation of cuttings (e.g., pieces of subterranean formation dislodged by a cutting action of teeth on the drill bit) to the surface, controlling formation fluid pressure to block blowouts, maintaining wellbore stability, suspending solids in the wellbore, minimizing fluid loss into and stabilizing the subterranean formation through which the wellbore is being drilled, fracturing the subterranean formation in the vicinity of the wellbore, displacing fluid within the wellbore with another fluid, cleaning the wellbore, testing the wellbore, treating the wellbore, treating the subterranean formation, transmitting hydraulic horsepower to the drill bit, emplacing a packer, abandoning the wellbore, and/or preparing the wellbore for abandonment, for example.

The drilling fluid is often a water-based drilling fluid (WBM) that is selected for use in the wellbore because of relatively low costs and acceptance of the WBM (e.g., in comparison to oil-based drilling fluids [OBM] and/or synthetic-based drilling fluids [SBM]). Some subterranean formations may be at least partly composed of clays, including shales, mudstones, siltstones, and claystones, which swell in a presence of water and may cause an increase in drilling times and/or costs associated with drilling operations. In particular, such clay-containing subterranean formations may result in various issues, such as bit balling, swelling or sloughing of the wellbore, stuck pipe, and/or dispersion of cuttings. Furthermore, the various issues may be exacerbated as water content of the WBM increases due to clay hydration in the clay-containing subterranean formations. Accordingly, it is desirable to select a composition of the drilling fluid based upon characteristics of the subterranean formation, such that the composition of the drilling fluid may block and/or limit some of the above-noted issues. Notably, while certain examples herein refer to WBMs to facilitate discussion, it should be appreciated that it may be desirable to select a composition of OBMs and/or the SBMs in similar ways. Thus, the techniques disclosed herein may be applied and used with WBMs, OBMs, and/or SBMs.

It is also presently recognized that it is desirable to perform tests (e.g., chemical tests) on the drilling fluid, such as prior to and/or during drilling operations, to assess whether the drilling fluid corresponds to (e.g., matches) the selected composition of the drilling fluid. In particular, the tests may indicate the composition of the drilling fluid (e.g., respective concentrations of components of the drilling fluid). Then, the composition of the drilling fluid may be utilized to maintain an integrity of the drilling fluid, such as by informing an operator (e.g., a mud engineer; a human operator) that it is an appropriate time to add components to the drilling fluid (e.g., to maintain certain levels of the components to correspond to the selected composition of the drilling fluid) for effective drilling operations.

Without the disclosed embodiments, the operator may manually conduct wet chemistry and/or titration-based tests that are tedious and time consuming in order to determine the composition of the drilling fluid. Further, such wet chemistry and/or titration-based tests may suffer from inaccuracies and/or interference (e.g., poor ability to distinguish certain components from one another). Even further, such wet chemistry and/or titration-based tests are performed on drilling fluid filtrates and not on direct drilling mud (e.g., direct drilling fluid; without filtration). Considering these complexities and inaccuracies with existing techniques, it is often the case that certain components are added to the drilling fluid in amounts that are more than needed for successful drilling operations; therefore, these existing techniques tend to result in waste and/or unnecessary costs.

Advantageously, the present embodiments relate to a drilling fluid analysis system that uses capillary electrophoresis (CE) techniques to determine the composition of the drilling fluid. For example, the CE techniques may be used to test for respective concentrations of one or more inhibitors present in the drilling fluid, one or more ions present in the drilling fluid, and so on. Indeed, the CE techniques may be used to test for respective concentrations of all components/ingredients in the drilling fluid (including components/ingredients leached from the subterranean formation). The CE techniques may be implemented via a CE device or system that is portable and/or present at a wellsite (e.g., in a vicinity of the wellbore, such as within 25, 50, or 100 meters of the wellbore), and thus, the CE techniques may provide real-time (e.g., substantially real-time, such as within minutes and/or during the drilling operations) quality analysis/control at the wellsite. Notably, the CE techniques may not require and/or do not utilize an addition of any tracer to the drilling fluid to determine the composition of the drilling fluid. Additionally, the CE techniques may be performed on direct drilling muds (e.g., direct drilling fluids; without filtration), which may reduce a time to test the drilling fluid and/or provide more accurate results (e.g., as compared to titration-based tests).

The CE techniques may provide the respective concentrations of the components of the drilling fluid, and the respective concentrations may in turn be utilized to maintain the integrity of the drilling fluid. The detailed, robust outputs provided by the CE techniques may also enable assessment of interactions between the one or more inhibitors and the subterranean formation, as well as provide information about a formation composition of the subterranean formation. These and other features of the drilling fluid analysis system are described in more detail herein.

FIG. 1 is a schematic diagram of a drilling system 10 with a drilling fluid analysis system 12 (e.g., drilling mud analysis system), in accordance with an embodiment of the present disclosure. The drilling fluid analysis system 12 is configured to analyze a composition of a drilling fluid, provide feedback (e.g., visual feedback via a display screen), and/or carry out other tasks to facilitate efficient and effective drilling operations. While FIG. 1 illustrates a land-based drilling system to facilitate discussion, it should be understood that the disclosed embodiments may be adapted for use with an offshore drilling system.

As shown, a wellbore 14 is formed in a subterranean formation, and a drill string 16 is suspended within the wellbore 14. The drill string 16 may include a drill bit 18 that cuts through the subterranean formation to form or to drill the wellbore 14. A mast 20 is positioned on a drill floor 22 and over the wellbore 14. A hoisting system 24 includes a crown block 26, a traveling block 28, and a drawworks system 30. A cable 32 (e.g., wire) extends from the drawworks system 30 and couples the crown block 26 to the traveling block 28. In the illustrated embodiment, a top drive 34 is coupled to the traveling block 28. The top drive 34 rotates the drill string 16 as the hoisting system 24 raises and lowers the top drive 34 and the drill string 16 relative to the drill floor 22 to facilitate drilling of the wellbore 14. It should be appreciated that hoisting systems having various other components (e.g., swivels) and/or configurations may be utilized to drive movement of the drill string 16.

A pump 42 (e.g., piston pump) is configured to pump a drilling fluid (e.g., drilling mud; water-based, oil-based, or synthetic-based drilling fluid) into the wellbore 14. For example, the pump 42 may be used to pump the drilling fluid from a drilling fluid tank 44 during drilling operations. In particular, the pump 42 may be used to pump the drilling fluid from the drilling fluid tank 44, through a fluid conduit 46 (e.g., pipe, line), through a port in the top drive 34, and into an interior channel in the drill string 16, as shown by arrow 48. The drilling fluid may exit the drill string 16 via ports in the drill bit 18, and then circulate upwardly through an annular passage between an outer surface (e.g., annular surface) of the drill string 16 and an inner surface (e.g., annular surface) that defines the wellbore 14, as shown by arrows 50. The drilling fluid may then return to the drilling fluid tank 44 via a fluid conduit 52 (e.g., pipe).

The drilling fluid may be optimized and/or designed in a laboratory following American Petroleum Institute (API) recommended practices or standards. At a laboratory scale and in a laboratory environment, it may be generally straightforward to prepare the drilling fluid to correspond to (e.g., match) a target formulation for the drilling fluid by weighing each additive. However, during drilling operations, certain additives (e.g., inhibitors) that are configured to interact with clay in the subterranean formation and/or block swelling of the clay may be consumed by the subterranean formation (e.g., the concentration of the additives may be affected, such as decreased, as the drilling fluid circulates through the wellbore 14).

It is important to monitor and maintain a correct level or concentration of such additives for operational efficiency and success in the drilling operations. Accordingly, the drilling fluid analysis system 12 disclosed herein includes a capillary electrophoresis (CE) device 60 (or CE system) that enables sampling and testing of the drilling fluid, such as during the drilling operations and/or nearby the wellbore 14 (e.g., in a vicinity of the wellbore 14, such as within 25, 50, or 100 meters of the wellbore 14). More particularly, the CE device 60 may be configured to analyze the composition of the drilling fluid, such as respective concentrations of components of the drilling fluid. For example, the CE device 60 may be configured to analyze the respective concentrations of one or more additives (e.g., inhibitors), one or more ions, and so on. The CE device 60 may rely upon minimum, or in some cases, no preparation of a sample of the drilling fluid (e.g., no addition of tracers, such as nitrate; supplied directly from the drilling fluid tank 44 and/or any of the fluid conduits 46, 52; without filtration to remove solids).

As shown, the CE device 60 may include a source vial 62, a destination vial 64, a capillary tube 66, electrodes 68, and a power supply 70. The source vial 62, the destination vial 64, and the capillary tube 66 may be filled with an electrolyte, such as an aqueous buffer solution. To introduce a sample (e.g., of the drilling fluid), an inlet of the capillary tube 66 may be placed into a sample vial 72 that contains the sample. The sample may be introduced into the capillary tube 66 via capillary action, pressure, siphoning, or electrokinetically, and the inlet of the capillary tube 66 is then returned to the source vial 62.

Migration of components in the sample is initiated by an electric field that is applied between the source vial 62 and the destination vial 64 by the electrodes 68 connected to the power supply 70. In certain CE techniques, ions are pulled through the capillary tube 66 in one direction by electroosmotic flow. The components separate as they migrate due to their different electrophoretic mobility and are detected by a detector 74 (e.g., ultraviolet [UV] or ultraviolet-visible [UV-VIS] absorption detector, mass spectrometer, fluorescence detector, electrochemical detector, conductivity detector, and/or optical detector) near an outlet of the capillary tube 66. An output of the detector 74 may be provided to a processing device or system, which may include a processor 76, a memory device 78, a storage device 80, a communication device 82, and/or an output device 84 (e.g., a speaker, a light emitter, and/or a display screen).

The processor 76 may be any type of computer processor or microprocessor capable of executing computer-executable code. The memory device 78 and the storage device 80 may be any suitable articles of manufacture that can serve as media to store processor-executable code, data (e.g., calibration curves), or the like. These articles of manufacture may represent computer-readable media (e.g., any suitable form of memory or storage) that may store the processor-executable code used by the processor 76 to perform various techniques disclosed herein. The memory device 78 and the storage device 80 may represent non-transitory computer-readable media (e.g., any suitable form of memory or storage). It should be noted that non-transitory merely indicates that the media is tangible and not a signal.

The communication device 82 may be configured to facilitate communication between the drilling fluid analysis system 12 and other components of the drilling system 10 (e.g., via a wired and/or wireless network). For example, the communication device 82 may communicate data, information, alerts, recommendations, and/or control signals to other components of the drilling system 10. The output device 84 may operate as a human machine interface (HMI) to depict visualizations associated with software or executable code being processed by the processor 76. For example, the output device 84 may be a display screen, such as a touch display screen that is also capable of receiving inputs from an operator (e.g., a mud engineer; a human operator). The output device 84 may be any suitable type of display screen, such as a liquid crystal display (LCD) screen, plasma display screen, or an organic light emitting diode (OLED) display screen, for example.

It should be noted that the components described above with regard to the drilling fluid analysis system 12 are merely examples, and the drilling fluid analysis system 12 may include additional or fewer components. In some embodiments, the drilling fluid analysis system 12 may be a distributed system that includes multiple processors. Indeed, as used herein, the term "processing device or system" refers to an electronic computing device or system such as, but not limited to, a single computer, virtual machine, virtual container, host, server, laptop, and/or mobile device, or to multiple electronic computing devices working together to perform the function(s) described herein.

As shown, the drilling fluid analysis system 12 may also include a rheology testing system 86 (e.g., rheometer, such as an automated or semi-automated rheometer). The rheology testing system 86 may include one or more sensors that test rheology, plastic viscosity, yield point, low shear yield point, and/or other characteristics of the drilling fluid. While the rheology testing system 86 is shown within the drilling fluid analysis system 12 to facilitate discussion, it should be appreciated that the rheology testing system 86 may be a stand-alone system (e.g., having its own processor, memory device, storage device, communication device, and/or display screen) that communicates with the drilling fluid analysis system 12 (e.g., provide a rheology profile to the drilling fluid analysis system 12). Indeed, as noted herein, the drilling fluid analysis system 12 may be a distributed system that includes multiple processors, and this is intended to cover various embodiments in which certain components that are shown within the drilling fluid analysis system 12 in FIG. 1 are stand-alone components that communicate with one another. Various operations and techniques that may be carried out with the drilling fluid analysis system 12 are described in more detail with reference to FIGS. 2-9.

Figure 2:
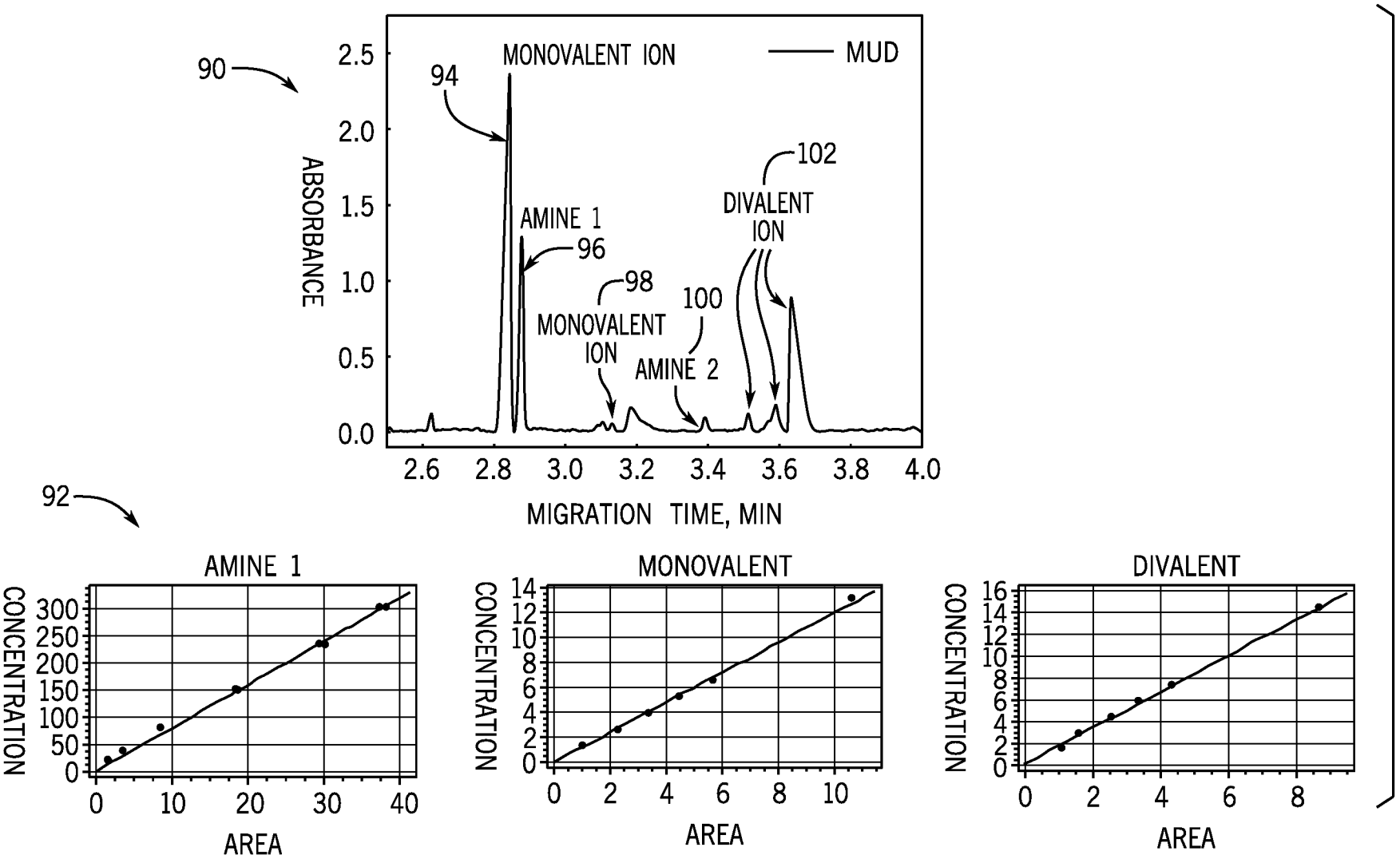
FIG. 2 illustrates examples of graphs that show components of a drilling fluid and calibration curves that are used to determine respective concentrations of the components of the drilling fluid, in accordance with an embodiment of the present disclosure.

FIG. 2 illustrates examples of a drilling fluid component graph 90 that shows components of a drilling fluid and calibration graphs 92 with calibration curves that may be used to determine respective concentrations of the components of the drilling fluid, in accordance with an embodiment of the present disclosure. The drilling fluid component graph 90 may be generated based on the output of the detector 74 of FIG. 1 and may be an electropherogram that represents a response of the detector 74 as a function of time.

As shown, separated chemical compounds (e.g., components of the drilling fluid) appear as peaks with different retention times, and each peak may be determined to correspond to a particular separated chemical compound by comparing a respective migration time of each peak with that of a known chemical compound. Furthermore, a respective area under each peak is proportional to a concentration of the particular separated chemical compound. For example, the calibration graphs 92 may be established for certain components used in the drilling fluid, and then the calibration graphs 92 may be referenced to determine the respective concentration for any of the components of interest that are identified in the electropherogram.

As a specific example with reference to the drilling fluid component graph of FIG. 2, various components of a drilling fluid are identified via a first peak 94 that indicates a first ion (e.g., first monovalent ion), a second peak 96 that indicates a first additive (e.g., first component/element/ingredient, such as an amine, of an inhibitor), a third peak 98 that indicates a second ion (e.g., second monovalent ion), a fourth peak 100 that indicates a second additive (e.g., second component/element/ingredient, such as an amine, of the inhibitor), and a fifth peak 102 that indicates a third ion (e.g., divalent ion). The calibration graphs 92 may be used to correlate the area under each peak to a concentration, and thus, the CE device 60 may output the respective concentrations of the components of the drilling fluid (e.g., a first concentration of the first ion, a second concentration of the first additive, and so on). Advantageously, because CE techniques are able to separate components in this way (e.g., separate multiple amines of the inhibitor), it is possible to effectively track a concentration of the inhibitor generally even if one of the components of the inhibitor is obscured or otherwise undetectable in a current testing cycle (e.g., due to product decomposition). Furthermore, the results provide increased confidence levels regarding the concentration of the inhibitor generally due to the output including respective concentrations of multiple components of the inhibitor. It should be appreciated that additional separation and/or analysis techniques may be used in conjunction with (e.g., sequentially or at the same time) with the CE techniques to confirm the respective concentration for each of the components in the drilling fluid.

Some additional examples of components in the drilling fluid that may be identified via the CE techniques include chloride, calcium, magnesium, sulfate, potassium, and/or various inhibitors (e.g., amine-based inhibitors; phosphate-containing inhibitors). With respect to chloride, it may be desirable to limit a concentration of chloride to satisfy certain regulations, or alternatively, to add chloride to change a density of the drilling fluid or to reduce water activity of WBM for inhibition functionality in the subterranean formation. With respect to calcium and magnesium, drilling fluids are affected by "hard water" that contains large amounts of dissolved calcium and magnesium salts. Additionally, the hard water may negatively impact polymeric viscosifiers and/or use more bentonite to make a satisfactory drilling fluid. Thus, it may be desirable to test (e.g., with the CE device 60) various water supplies and choose water with lower amounts of dissolved calcium and magnesium salts, or at least treat the water before use in the drilling fluid. It may also be desirable to routinely (e.g., periodically) test the drilling fluid for dissolved calcium and magnesium salts, as these may be picked up in the subterranean formation (e.g., drilling cement plugs or certain shales). With respect to sulfate, it may be desirable to limit a concentration of sulfate, as it may be picked up in the subterranean formation and contribute to high viscosity and fluid-loss control issues. With respect to potassium, it may be desirable to limit a concentration of potassium to satisfy certain regulations, or alternatively, to add potassium to lend stability to shale exposed to the drilling fluid (e.g., especially in water-sensitive, brittle shale) and/or to help hold cuttings together, for example.

With respect to inhibitors, the inhibitors react rapidly with contacted clays via a cation exchange mechanism and are provided in the drilling fluid to treat sensitive shales (e.g., to reduce sensitivity to the drilling fluid). Notably, titration-based techniques result in interference due to other amine-containing additives in the drilling fluid, and thus, are unable to reliably and accurately identify the inhibitors. However, the CE techniques disclosed herein enable separation and identification of the inhibitors (e.g., one or more components of one or more inhibitors). In particular, the CE techniques disclosed herein enable separation and identification of neutral, cationic and/or anionic components of one or more inhibitors (e.g., amines). The CE techniques may also enable separation and identification of shale encapsulators, polymeric viscosifiers (e.g., partially hydrolyzed polyacrylamide [PHPA]), and/or any other component of the drilling fluid that is soluble and/or can be made soluble and/or optionally charged by a chemical treatment of a sample of the drilling fluid (e.g., latex that can be charged by hydrolysis; synthetic fluid loss control [FLC] fluids that can be made to be anionic via hydrolysis). The CE techniques may analyze the drilling fluid for a byproduct that is produced by a chemical treatment of the drilling fluid. For example, hydrolysis of esters makes acid anions, which is thus indicative of a presence of esters in the drilling fluid (e.g., original drilling fluid; at some prior time). As another example, oxidation of starches produces acids, which is also indicative of a presence of certain biopolymers in the drilling fluid (e.g., original drilling fluid; at some prior time).

Indeed, the CE techniques disclosed herein may be used to identify and quantify some or all components (e.g., individual organic and/or inorganic compounds) of any of a variety of inhibitors (e.g., with at least one component soluble in a solvent of interest, such as water in the case of WBM). It should be appreciated that the CE techniques may be used to monitor concentrations of one or more components of the drilling fluid periodically (e.g., according to a schedule, such as every hour, two hours, 12 hours, or more) and/or in response to certain events (e.g., initiation of drilling operations, upon reaching a certain depth in the wellbore 14, upon reaching certain rheology numbers or thresholds, upon receipt of an input command/request by the operator). Thus, the drilling fluid analysis system 12 may provide multiple updates and/or outputs to guide the drilling operations.

Figure 3:
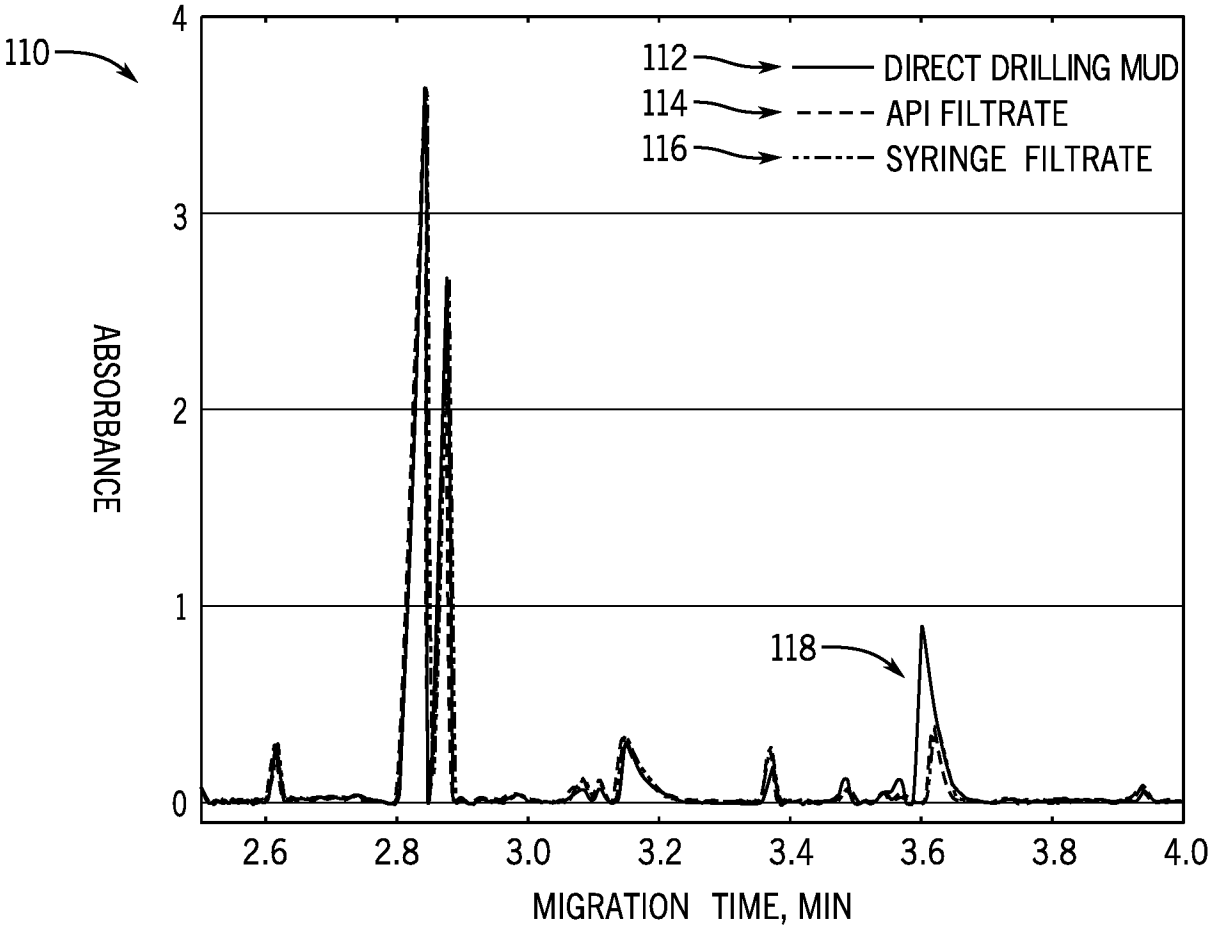
FIG. 3 illustrates an example of a graph that shows variations in the concentration of an inhibitor of a drilling fluid without filtration of the drilling fluid and with filtration of the drilling fluid via different filtration techniques, in accordance with an embodiment of the present disclosure.

FIG. 3 illustrates an example of a graph 110 that shows variations in a concentration of an inhibitor of a drilling fluid without filtration of the drilling fluid and with filtration of the drilling fluid via different filtration techniques, in accordance with an embodiment of the present disclosure. In particular, a first line 112 may represent a respective electropherogram for a direct drilling mud, a second line 114 may represent a respective electropherogram for an API filtrate of the drilling fluid, and a third line 116 may represent a respective electropherogram for a syringe filtrate of the drilling fluid. As shown, the electropherograms vary because the composition of the drilling fluid may be affected by filtration processes. For example, the first line 112 includes a peak 118 that is different than corresponding peaks in the second line 114 and the third line 116. (e.g., the peak 118 has a higher, larger area than the corresponding peaks in the second line 114 and the third line 116).

Advantageously, the drilling fluid analysis system 12 and the CE device 60 may be capable of directly sampling the drilling fluid (e.g., without filtration to remove solids), which may provide more accurate results regarding the composition of the drilling fluid (e.g., that is delivered into and/or returned from the wellbore 14, instead of a filtered version of the drilling fluid). This also may enable effective testing on leachates from solids used in the drilling fluid and/or encountered (e.g., added) via interaction with the subterranean formation. More particularly, the drilling fluid may be sampled (e.g., provided to the sample vial 72 of FIG. 1 and introduced into the inlet of the capillary tube 66) from the drilling fluid tank 44 and/or from any of the fluid conduits 46, 52 without carrying out filtration processes, such as API filtration processes (e.g., to create an API filtrate) and/or syringe filtration processes (e.g., to create a syringe filtrate). However, it should be appreciated that the CE device 60 may also or instead be utilized to sample filtrates (e.g., API filtrates, syringe filtrates, and/or other filtrates).

Figure 4:
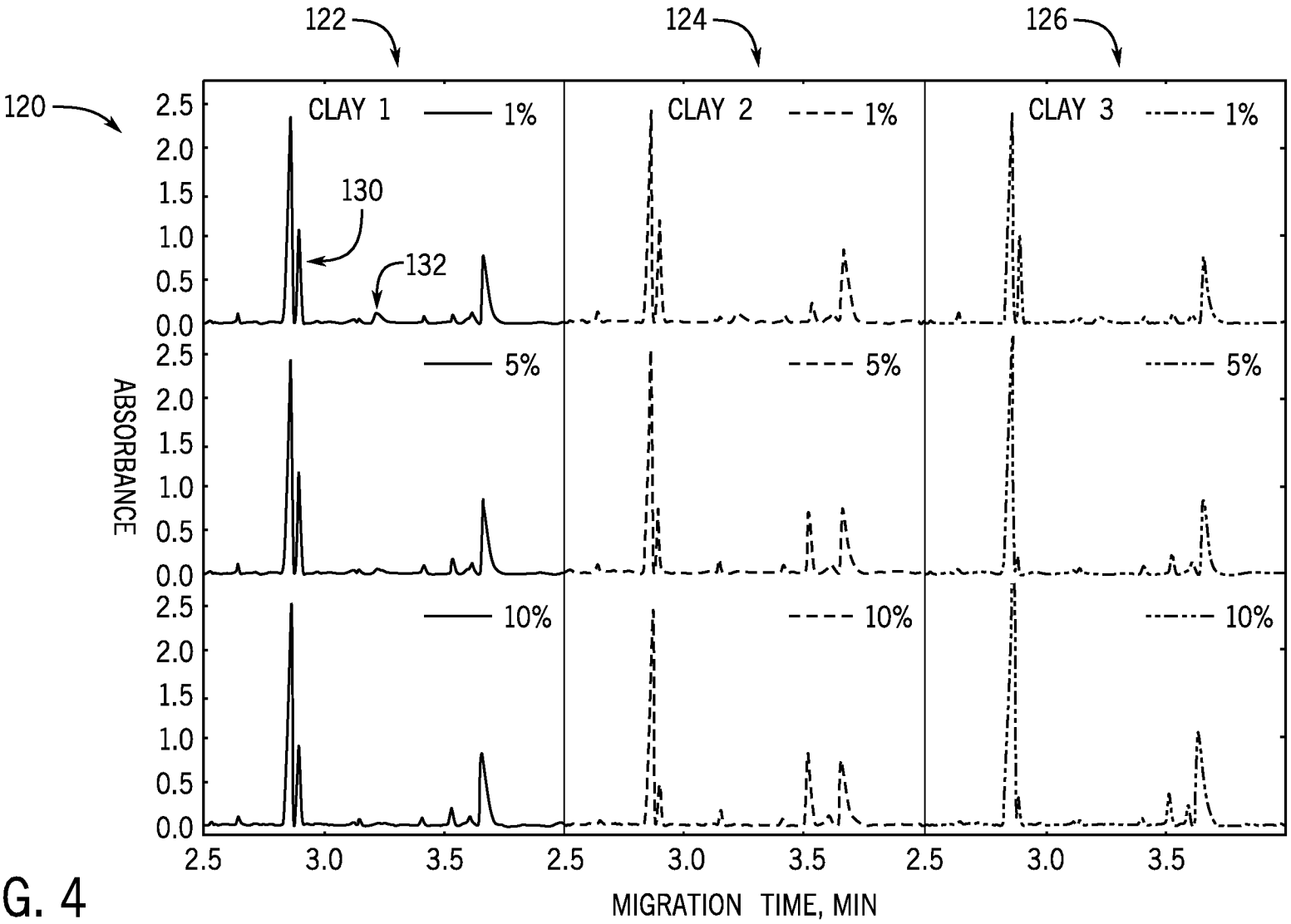
FIG. 4 illustrates examples of graphs that show variations in a concentration of an inhibitor of a drilling fluid due to clay reactivity, in accordance with an embodiment of the present disclosure.

FIG. 4 illustrates examples of graphs 120 that show variations in a concentration of an inhibitor of a drilling fluid in a presence of different amounts and types of clay (e.g., having different reactivity levels), in accordance with an embodiment of the present disclosure. The graphs 120 are intended to demonstrate that the CE techniques performed on the drilling fluid may be useful in assessing performance of the drilling fluid, as well as characteristics (e.g., properties and/or composition) of a subterranean formation.

The graphs 120 include a first column of graphs 122 representing a drilling fluid mixed with a first clay, and specifically (1) a top graph with a first amount of the first clay (e.g., 1 percent), a middle graph with a second amount of the first clay (e.g., 5 percent), and a bottom graph with a third amount of the first clay (e.g., 10 percent). The graphs 120 also include a second column of graphs 124 representing the drilling fluid mixed with a second clay, and specifically (1) a top graph with a first amount of the second clay (e.g., 1 percent), a middle graph with a second amount of the second clay (e.g., 5 percent), and a bottom graph with a third amount of the second clay (e.g., 10 percent). The graphs 120 also include a third column of graphs 126 representing the drilling fluid mixed with a third clay, and specifically (1) a top graph with a first amount of the third clay (e.g., 1 percent), a middle graph with a second amount of the third clay (e.g., 5 percent), and a bottom graph with a third amount of the third clay (e.g., 10 percent).

In each of the graphs 120, a first peak 130 represents a first additive (e.g., inhibitor component) and a second peak 132 represents a second additive (e.g., inhibitor component). As shown, the first peak 130 and the second peak 132 change (e.g., disappear) at different rates in the graphs 120. The changes and/or rates of the changes indicate reactivity levels of the clays. For example, the first peak 130 and the second peak 132 grow smaller and/or disappear most slowly (e.g., at a first rate) upon addition of more of the first clay, while the first peak 130 and the second peak 132 grow smaller and/or disappear more quickly (e.g., at a second rate that is greater than the first rate) upon addition of more of the second clay. Further, the first peak 130 and the second peak 132 grow smaller and/or disappear most quickly (e.g., at a third rate that is greater than the second rate) upon addition of more of the third clay. Thus, the graphs 120 illustrate that the first clay is least reactive (e.g., a first, lowest reactivity level), the second clay is less reactive (e.g., a second, intermediate reactivity level), and the third clay is most reactive (e.g., a third, highest reactivity level) with respect to the drilling fluid (e.g., the first and second additives in the drilling fluid).

In operation, the drilling fluid analysis system 12 may determine and analyze component concentration trends, which include the respective rate of change of the concentration of one or more components (e.g., inhibitors, ions) of the drilling fluid. Notably, the drilling fluid analysis system 12 may output the respective rate of change, which may provide information about which component(s) of the one or more inhibitors has been or is being consumed the subterranean formation. In any case, the drilling fluid analysis system 12 may output the rate of change via the output device 84 (e.g., in real-time, upon completion of each test) to enable the operator to evaluate the reactivity level of the subterranean formation, evaluate the composition of the drilling fluid, evaluate changes in the composition of the drilling fluid, evaluate a formation composition of the subterranean formation, and/or plan for adjustments to the drilling fluid. Then, the operator may add more of certain components to the drilling fluid at an appropriate time, such as to account for the reactivity level of the subterranean formation and to maintain the integrity of the drilling fluid, to continue successful drilling operations.

It should be appreciated that the drilling fluid analysis system 12 may be configured to carry out any of a variety of levels of processing, analysis, and/or control. As noted above, the drilling fluid analysis system 12 may be configured to process the data from the detector 74 of FIG. 1 and output the respective concentrations of the components of the drilling fluid, and then the operator may carry out further analysis to assess the drilling fluid and/or to adjust the drilling fluid. However, in some embodiments, the drilling fluid analysis system 12 may utilize one or more algorithms and/or look-up tables to carry out more advanced processing, analysis, and/or control. For example, the drilling fluid analysis system 12 may utilize one or more algorithms and/or look-up tables that relate the respective rates of change of the components in the drilling fluid to (1) a reactivity level of the subterranean formation and/or (2) the formation composition of the subterranean formation. Then, the drilling fluid analysis system 12 may determine the reactivity level of the subterranean formation and/or the formation composition of the subterranean formation, and the drilling fluid analysis system 12 may provide an output indicative of the reactivity level and/or the formation composition via the output device 84. This information may assist and guide the operator to add more of certain components to the drilling fluid at an appropriate time, such as to account for the reactivity level of the subterranean formation and to maintain the integrity of the drilling fluid, to continue successful drilling operations. Generally, the output indicative of the reactivity level may include a level indicator along a scale (e.g., highly reactive, moderately reactive, slightly reactive, non-reactive) and/or a numerical level indicator along a numerical scale (e.g., on a scale of 1 to 10, with 1 being non-reactive and 10 being highly reactive) to facilitate comparison and/or assessment, for example.

In some embodiments, the drilling fluid analysis system 12 may access the target formulation (e.g., from the storage device 80) and/or update the target formulation (e.g., based on the reactivity level of the subterranean formation, the formation composition, the changes in the composition of the drilling fluid during the drilling operations). Then, the drilling fluid analysis system 12 may determine the adjustments that, if made to the drilling fluid, would cause the drilling fluid to correspond to the target formulation. In such cases, the drilling fluid analysis system 12 may provide an output indicative of the adjustments via the output device 84. For example, the output may instruct the operator to add a certain quantity of an inhibitor or other component to the drilling fluid at a current time or at a future time. It should be appreciated that the drilling fluid analysis system 12 may be configured to calculate or to estimate (e.g., predict) the future time based on the respective rates of change of the components, the reactivity level of the subterranean formation, the formation composition, the composition of the drilling fluid, the target formulation of the drilling fluid, and/or other parameters (e.g., a mixing time to reach the target formulation). In any case, this information may assist and guide the operator to add more of certain components to the drilling fluid at the appropriate time, to thereby maintain the integrity of the drilling fluid and to continue successful drilling operations. Furthermore, in some embodiments, the drilling fluid analysis system 12 may provide a control signal that controls flow devices (e.g., valves) to add one or more components (e.g., in respective quantities) to the drilling fluid to provide automated control (e.g., feedback loop).

Drilling into a reactive shale may show a decrease in inhibitor and an increase in metal cations because the inhibitor reacts with the shale by the cation exchange process (e.g., when the inhibitor is adsorbed on the shale, cations are released). Using the CE techniques to track both the inhibitor and one or more metal cations together may increase a confidence level in the assessment of the drilling fluid and the shale, as well as improve the drilling operations. Additionally, as noted herein, the CE techniques may be utilized to monitor sodium, potassium, calcium, and magnesium. A type of cation released from a cation exchange interaction process of shale and the inhibitor may provide additional information on the shale. For example, sodium and potassium smectites swell faster than calcium and magnesium smectites. Thus, the cations present in the shale (made available for analysis by the cation exchange in solution) may indicate a type of shale being drilled into and its tendency to expand, which the drilling fluid analysis system 12 and/or the operator may utilize to determine the formation composition, the reactivity level of the subterranean formation, and/or the adjustments that should be made to the drilling fluid for successful drilling operations.

Additionally, it should be appreciated that a rate of change of the inhibitor may provide particularly useful insight and guidance during the drilling operations. For example, due to ability of CE techniques to perform rapid and accurate analysis, it is possible to plot a derivative of a depletion rate of the inhibitor. The depletion rate of the inhibitor is a good indicator of drilling through a reactive subterranean formation and that the operator should be prepared to add component(s) to the drilling fluid. Thus, generally, the drilling fluid analysis system 12 may provide alerts based on the depletion rate of the inhibitor and/or determine an appropriate time (e.g., the current time or the future time) to make adjustments to the drilling fluid. For example, when the depletion rate reaches a threshold rate, the drilling fluid analysis system 12 may provide the alert via the output device 84 to notify the operator and/or the control signal to add one or more components to the drilling fluid.

Since the drilling fluid may experience losses into the subterranean formation, it is not always economical to run a high concentration of the inhibitor. At the same time, allowing depletion of the inhibitor and/or adding the inhibitor too late is problematic because adding the inhibitor after the drilling fluid is full of dispersed active clay may substantially increase fluid viscosity. Due to its accuracy and efficiency, the CE techniques enable the operator to run at a low-excess of the inhibitor and other additives, which improves economics of the drilling process without increasing a risk of not having enough inhibitor when drilling through difficult sections of the subterranean formation. Wet chemistry and titration-based techniques may not differentiate the various components in this way, and thus do not enable this type of assessment of characteristics of the subterranean formation and/or the ability to tune the drilling fluid in this dynamic, lean manner.

FIG. 5 illustrates an example of a table 150 that shows variations in rheology of a drilling fluid based on a time of addition of an inhibitor of the drilling fluid. The table 150 illustrates that it is important to maintain an appropriate amount of inhibitor in the drilling fluid. In particular, a first column 152 illustrates a baseline rheology of a drilling fluid that contains reactive clay and no inhibitor, as might occur upon drilling into a subterranean formation that has reactive clay without any inhibitor in the drilling fluid. In the first column 152, the rheology is generally high due to swelling of the reactive clay. A second column 154 illustrates a first example rheology upon addition of the inhibitor at this stage (e.g., after the drilling fluid contains the reactive clay). As shown, in the second column 154, the rheology increases further (e.g., more than the baseline rheology). Thus, transitioning from a dispersed drilling fluid (e.g., without inhibitor) to an inhibitive drilling fluid (e.g., with inhibitor) in the presence of the reactive clay may cause increases in rheology, which can be problematic during drilling operations.

Additionally, a third column 156 illustrates a second example rheology that might occur when the addition of the inhibitor occurs prior to the presence of the reactive clay in the drilling fluid. As shown, the second example rheology is lower than the baseline rheology and this demonstrates the importance of adding the inhibitor prior to the addition or presence of reactive clay in the drilling fluid, and thus, the importance of maintaining sufficient amounts of the inhibitor at all times. As noted herein, the CE techniques enable accurate monitoring and control of levels of inhibitor in the drilling fluid and/or characteristics of the subterranean formation to avoid problematic scenarios, such as those illustrated by the increase in rheology due to the late addition of the inhibitor (e.g., the second column 154; after the presence of reactive clay in the drilling fluid), without always using or defaulting to use of excess inhibitor. In FIG. 5, the rheological parameters may be obtained via the rheology testing system 86 of FIG. 1, and the rheological parameters may include plastic viscosity (PV), yield point (YP), low shear yield point (LSYP), and/or other characteristics of the drilling fluid. Additionally, a formulation table 158 provides an example of a formulation of the drilling fluid; however, the techniques disclosed herein may be utilized with any of a variety of drilling fluids.

Evaluation of the rheology of the drilling fluid and the composition of the drilling fluid may provide additional information about the subterranean formation and/or the drilling operations. For example, an increase in solids composed of non-reactive clays will increase viscosity of the drilling fluid. In such cases, the operator may consider adding more inhibitor to counteract the increase in the viscosity of the drilling fluid. However, non-reactive (or low-reactive) shale will not have or show any interaction with the inhibitor, and thus, the addition of more inhibitor will not be effective to counteract the increase in the viscosity of the drilling fluid in such cases.

Advantageously, the concentration of the components in the drilling fluid and the rheology data for the drilling fluid may be cross-referenced (e.g., analyzed together) to provide a better understanding of the subterranean formation and to make suitable decisions during the drilling operations. In particular, if the concentration of the inhibitor does not decrease while the rheology increases (or remains substantially the same), that may mean there are drilling issues other than a presence of a reactive shale. For example, the drilling issues could be a non-reactive shale, unsuitable inhibitor in the drilling fluid (e.g., improper for the subterranean formation), and/or inoperative solids control equipment (e.g., filters). In some embodiments, the drilling fluid analysis system 12 may provide an indication of the concentration of the inhibitor in the drilling fluid and the rheology data (e.g., over time; trends), such as side-by-side via the output device 84. Then, the operator may visualize this information and be informed to make appropriate decisions for the drilling operations. As noted herein, the drilling fluid analysis system 12 may be configured to carry out more advanced processing, such as to monitor the concentration of the inhibitor and the rheology data (e.g., over time; trends) to determine that there is a drilling issue that warrants attention, and the drilling fluid analysis system 12 may output an alert via the output device 84 to recommend that the operator review data, make adjustments, and/or take some other action. For example, in response to identifying no decrease in the concentration of the inhibitor and a simultaneous increase in the rheology, the drilling fluid analysis system may output the alert. Furthermore, the drilling fluid analysis system 12 may determine and provide outputs indicative of recommended adjustments and/or actions to address particular drilling issues identified based on the data. In some embodiments, the drilling fluid analysis system 12 may provide control signals (e.g., to control flow devices) to implement the recommended adjustments and/or actions to address particular drilling issues identified based on the data.

In any case, the application of CE may help the operator and/or the drilling fluid analysis system 12 conduct analysis, make correct decisions to avoid over-treatment of the drilling fluid with unnecessarily high levels of inhibitors, and/or perform other actions (e.g., adjustments to the drilling fluid). FIG. 6 illustrates an example of a table 160 that shows rheology of a drilling fluid due to a non-reactive clay, in accordance with an embodiment of the present disclosure. In particular, a first column 162 illustrates a baseline rheology of a drilling fluid that contains the non-reactive clay and no inhibitor, as might occur upon drilling into a subterranean formation that has the non-reactive clay without any inhibitor in the drilling fluid. A second column 164 illustrates an example rheology upon addition of the inhibitor at this stage (e.g., after the drilling fluid contains the non-reactive clay). As shown, in the second column 164, the rheology is substantially unchanged (e.g., the same as or similar to the baseline rheology). Thus, the addition of the inhibitor did not have any (or at least not a substantial) effect on the rheology. If the concentration of the inhibitor also does not decrease, then the drilling fluid analysis system 12 and/or the operator may determine that there are drilling issues other than the presence of reactive shale. A formulation table 166 provides an example of a formulation of the drilling fluid; however, the techniques disclosed herein may be utilized with any of a variety of drilling fluids.

Figure 7:
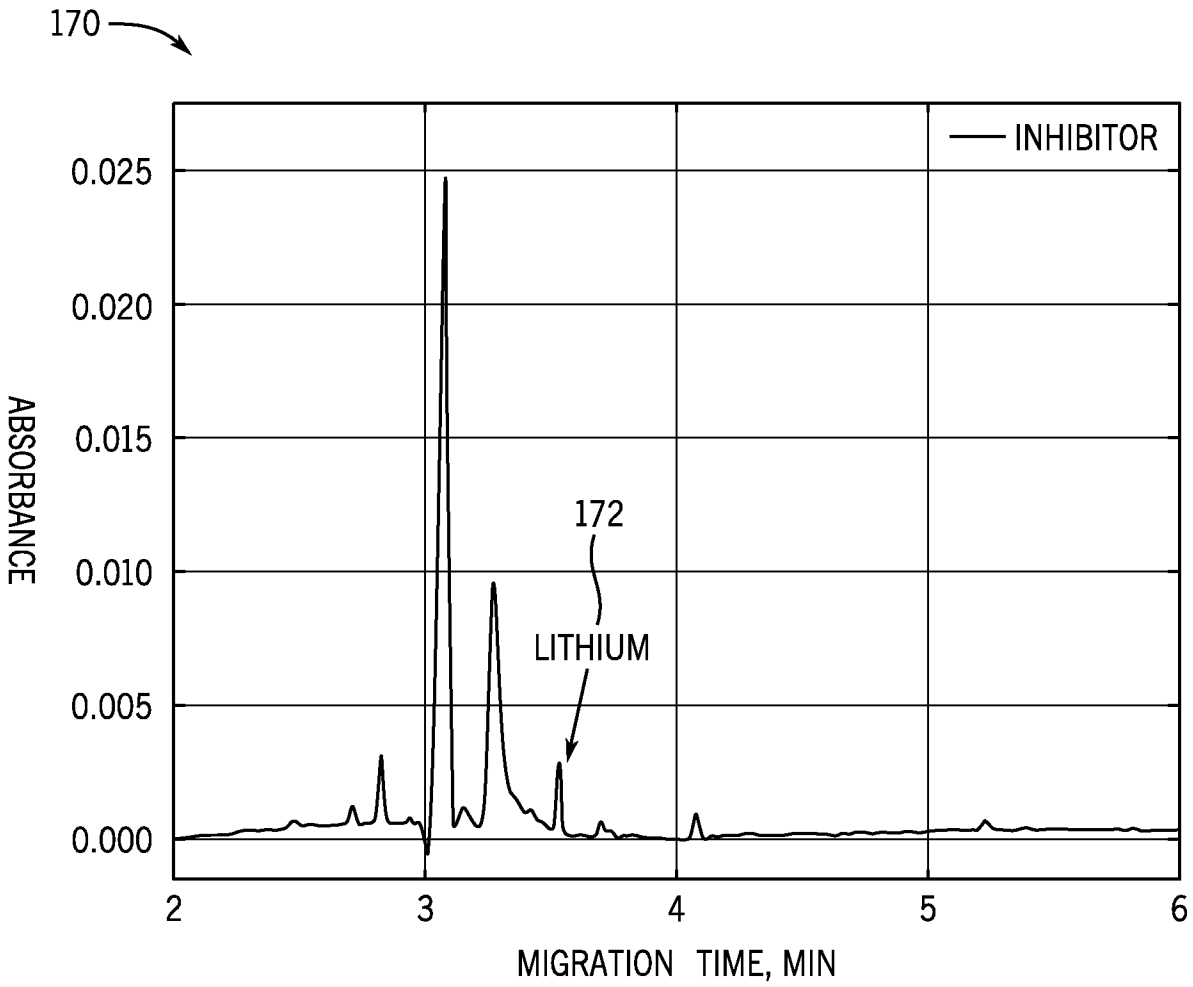
FIG. 7 illustrates an example of a graph that indicates a presence of a precious metal in a subterranean formation, in accordance with an embodiment of the present disclosure.

FIG. 7 illustrates an example of a graph 170 that indicates a presence of a precious metal in a subterranean formation, in accordance with an embodiment of the present disclosure. In particular, the graph 170 has a peak 172 that indicates a presence of Lithium along with other components of the drilling fluid. A drilling operation is often a first interaction with the subterranean formation, and analysis of the drilling fluid may provide information about components, such as any precious metals, present in the subterranean formation. For example, the components in the drilling fluid may be from the subterranean formation (e.g., leached/acquired from the subterranean formation as the drilling fluid circulates in the wellbore). Thus, a comparison of the components in the drilling fluid returned from the wellbore to the components in initial/base drilling fluid prior to the drilling operations and/or prior to a particular pass through the wellbore indicate the components in the drilling fluid that are from the subterranean formation. Also, if a depth of a drilling fluid return zone is known, the drilling fluid analysis system 12 may generate a log with information about a lithology (e.g., table; diagram; map) of the subterranean formation along with any precious metals present in the subterranean formation. In this way, the CE techniques may provide additional information about the subterranean formation, such as the composition of the subterranean formation. Notably, if completed for several wellbores, this may provide additional information about connections between subterranean formations.

The CE techniques may also be utilized to detect and quantify different types of drilling fluid additives that aid drilling in different types of environments, including harsh conditions. Importantly, this analysis may be performed simultaneously with different types of anions, such as chloride, which contribute to successful drilling operations. It should also be appreciated that the CE techniques may also be used to analyze water extracted from the drilling fluid during a de-watering step. The results may indicate the components in the water, which may indicate whether the water is acceptable for use in for future drilling operations. Thus, the drilling fluid analysis system 12 may determine and output information and/or recommendations related to reuse of the water, such as components to add to the water to tune the water for reuse in particular, suitable applications. Indeed, the CE techniques are not limited to the drilling fluid and the water, but may also be used for any of a variety of chemicals that might have not consumed and can be used for future drilling operations.

Figure 8:
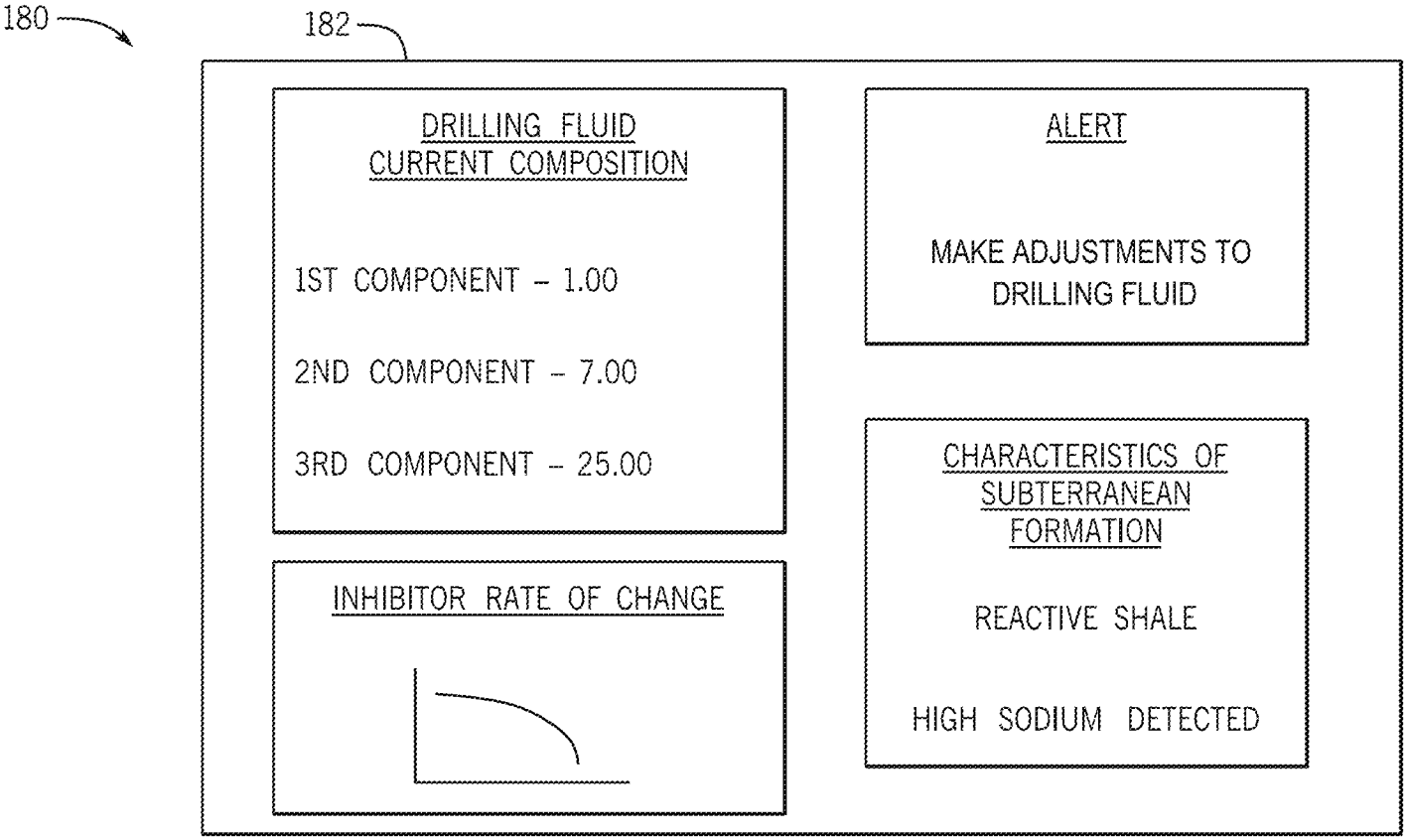
FIG. 8 illustrates an example of a graphical user interface that may be presented on a display screen for visualization by an operator, in accordance with an embodiment of the present disclosure.

FIG. 8 illustrates an example of a graphical user interface 180 that may be presented on a display screen 182 for visualization by an operator, in accordance with an embodiment of the present disclosure. The display screen 182 may be the output device 84 in FIG. 1. As shown, the graphical user interface 180 may include an indication of a composition of a drilling fluid, an indication of a rate of change of an inhibitor of the drilling fluid, an indication of characteristics of a subterranean formation, and an alert.

During a CE test cycle, the drilling fluid analysis system 12 of FIG. 1 may determine the composition of the drilling fluid (e.g., a first component of an inhibitor has a first concentration, a second component of the inhibitor has a second concentration, and a first metal cation has a third concentration). Then, the drilling fluid analysis system 12 may instruct display of this information on the display screen 182. The drilling fluid analysis system 12 may also analyze the respective concentrations of the components of the drilling fluid to determine one or more characteristics of the subterranean formation. For example, the drilling fluid analysis system 12 may determine a reactivity level of shale in the subterranean formation based on a rate of change of the first concentration of the first component of the inhibitor and/or a rate of change of the second concentration of the second component of the inhibitor. Additionally or alternatively, the drilling fluid analysis system 12 may determine a formation composition based on a type of the first metal cation (e.g., high sodium in the subterranean formation). The drilling fluid analysis system 12 may instruct output of any suitable alert. For example, the alert may include instructions to make adjustments to the drilling fluid and/or to add inhibitor to the drilling fluid (e.g., in response to the concentration of the inhibitor reaching or falling below a threshold; to add certain quantities of one or more components at a current time or at a future time).

The information shown in FIG. 8 is merely exemplary to facilitate discussion related to information that may be displayed for visualization by the operator. However, it should be appreciated that the graphical user interface 180 may include any information and/or data discussed herein, including the rheology parameters, any of the graphs (e.g., electropherograms), the component(s) to be added to the drilling fluid to match the target formulation, the certain quantity of each of the component(s) to be added to the drilling fluid to match the target formulation, the target formulation, the time to make the adjustments to the drilling fluid (e.g., the current time or the future time), the log with information about a lithology along the wellbore 14, analysis of extracted water and associated recommendations related to reuse of the extracted water, and so on. The graphical user interface 180 may include selectable input buttons (e.g., virtual buttons) that enable the operator to provide inputs to the drilling fluid analysis system 12, such as inputs to initiate a test with the CE device 60, to prompt display of more detailed results, and so on. In this way, the drilling fluid analysis system 12 operates as an advisory tool to assist the operator during the drilling operations.

Figure 9:
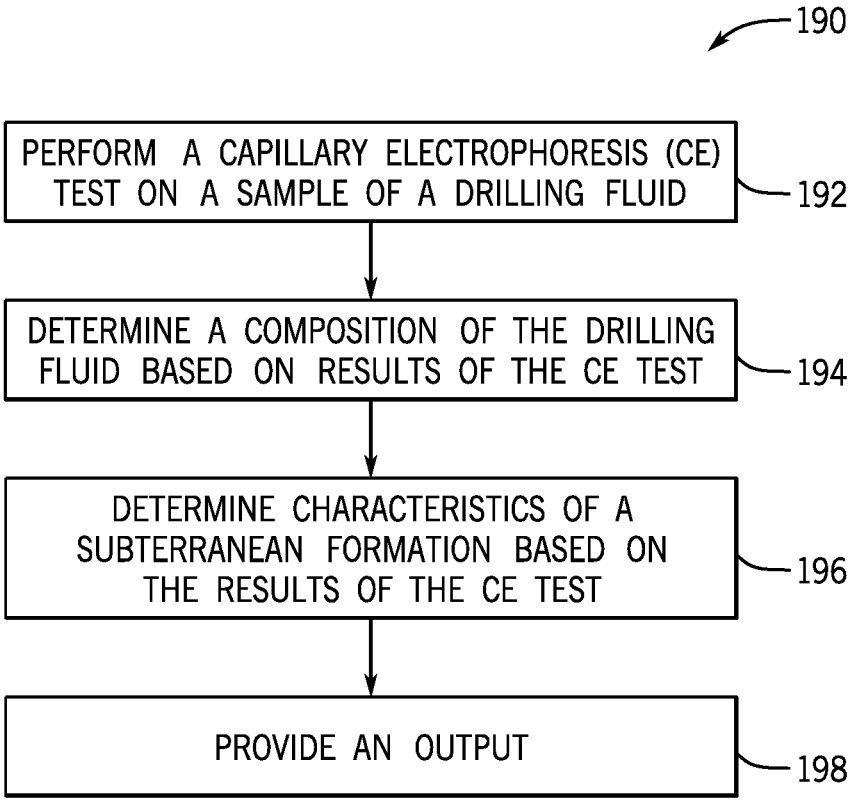
FIG. 9 is a flow diagram of a method of analyzing a drilling fluid, in accordance with an embodiment of the present disclosure.

FIG. 9 is a flow diagram of a method 190 of analyzing a drilling fluid, in accordance with an embodiment of the present disclosure. The following description of the method 190 is described as being performed by a system (e.g., the drilling fluid analysis system 12), but it should be noted that any suitable processor-based device or system may be specially programmed to perform any of the methods described herein. Moreover, although the following description of the method 190 is described as including certain steps performed in a particular order, it should be understood that the steps of the method 190 may be performed in any suitable order, that certain steps may be omitted, and/or that certain steps may be added.

In step 192, the method 190 may begin by performing a capillary electrophoresis (CE) test on a sample of a drilling fluid. In particular, a CE device may include a source vial, a destination vial, a capillary tube, electrodes, and a power supply. To introduce the sample of the drilling fluid, an inlet of the capillary tube may be placed into a sample vial that contains the sample of the drilling fluid. The sample may be introduced into the capillary tube, and then the inlet of the capillary tube is returned to the source vial. Migration of components in the sample is initiated by an electric field that is applied between the source vial and the destination vial by the electrodes connected to the power supply. The sample may be pulled through the capillary tube in one direction by electroosmotic flow, and components in the sample separate as they migrate due to their different electrophoretic mobility. Then, the components are detected by a detector near an outlet of the capillary tube.

As discussed herein, the CE device may rely upon minimum, or in some cases, no preparation of a sample of the drilling fluid (e.g., no addition of tracers, such as nitrate; supplied directly from a drilling fluid tank and/or any fluid lines that carry the drilling fluid to or from the wellbore; without filtration to remove solids). The CE device may be portable and/or present at a wellsite (e.g., in a vicinity of the wellbore, such as within 25, 50, or 100 meters of the wellbore). Thus, the CE techniques may be carried out at the wellsite to provide real-time (e.g., substantially real-time, such as within minutes and/or during the drilling operations) quality analysis/control during drilling operations.

In step 194, the method 190 may continue to determine a composition of the drilling fluid based on results of the CE test. In particular, the output of the detector may be utilized to generate an electropherogram, which identifies one or more components of the drilling fluid. Furthermore, calibration curves may be referenced to determine the respective concentrations of the one or more components of the drilling fluid. In step 196, the method 190 may continue to determine characteristics of a subterranean formation based on the results of the CE test. As noted herein, the one or more components of the drilling fluid and/or changes in the one or more components of the drilling fluid over time may indicate various characteristics of the subterranean formation that is being accessed via the drilling operations. For example, a rate of change of an inhibitor of the drilling fluid may indicate a reactivity level of shale in the subterranean formation, while a presence of certain metal cations may indicate a composition of the shale in the subterranean formation. Furthermore, examination of the results of the CE test together with rheology parameters may facilitate identification of other features/events, such as a non-reactive shale, improper drilling fluid for the subterranean formation, improper filtering of solids, or the like.

In step 198, the method 190 may continue to provide an output, such as via a graphical user interface shown on a display screen for visualization by an operator. The output may include the results of the CE test (e.g., the electropherogram), an indication of the composition of the drilling fluid, an indication of the characteristics of the subterranean formation, and/or any other information/data described herein.

While only certain features of the invention have been illustrated and described herein, many modifications and changes will occur to those skilled in the art. It is, therefore, to be understood that the appended claims are intended to cover all such modifications and changes as fall within the true spirit of the invention. Furthermore, features described with respect to FIGS. 1-9 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A drilling fluid analysis system, comprising:

a drilling system, comprising:

a drilling fluid tank;

a pump;

a wellbore line disposed in a wellbore and fluidly coupling the wellbore to the drilling fluid tank; and a fluid conduit fluidly coupling the wellbore to the pump;

a capillary electrophoresis device disposed between the wellbore and the pump such that the pump moves a drilling fluid through the fluid conduit from the wellbore to the capillary electrophoresis device, from the capillary electrophoresis device to the pump, and from the pump to the wellbore, the capillary electrophoresis device configured to perform a first test on a first sample of the drilling fluid including an initial drilling fluid from the drilling fluid tank and a second test on a second sample of the drilling fluid including a return drilling fluid from the wellbore; and a processor configured to:

analyze first results of the first test and second results of the second test to determine a characteristic of a subterranean formation, the characteristic based on a difference between a first concentration of reactive clay in the first sample and a second concentration of the reactive clay in the second sample; and provide an output based on the characteristic of the subterranean formation, the output comprising an amount of an inhibitor to add to the return drilling fluid and a time to add the inhibitor to the return drilling fluid.

2. The drilling fluid analysis system of claim 1, wherein the first test, the second test, and the processor are configured to analyze the first results and the second results to determine a rate of change in a concentration of the reactive clay.

3. The drilling fluid analysis system of claim 2, wherein the processor is configured to determine the characteristic of the subterranean formation based on the rate of change in the concentration of the reactive clay, and the characteristic comprises a reactivity level of the subterranean formation.

4. The drilling fluid analysis system of claim 1, wherein the processor is configured to analyze the first results and the second results to determine a concentration of a metal cation in the first sample and the second sample, and the characteristic comprises a composition of the subterranean formation.

5. The drilling fluid analysis system of claim 1, wherein the processor is configured to:

access a target formulation for the drilling fluid based on the characteristic of the subterranean formation; and determine an adjustment to the drilling fluid that, if completed, would cause the drilling fluid to match the target formulation for the drilling fluid, wherein the output comprises an additional indication of the adjustment.

6. A drilling system, comprising:

a drill string disposed in a wellbore;

a drilling fluid tank;

a pump configured to pump a drilling fluid from the drilling fluid tank into the drill string; and a drilling fluid analysis system configured to obtain a sample of the drilling fluid via the pump, wherein the drilling fluid analysis system comprises:

a capillary electrophoresis device disposed between the wellbore and the pump such that the pump moves the drilling fluid from the wellbore to the capillary electrophoresis device, from the capillary electrophoresis device to the pump, and from the pump to the wellbore, the capillary electrophoresis device configured to perform a test on the sample of the drilling fluid; and one or more processors configured to:

analyze results of the test to determine a concentration of a component in the sample of the drilling fluid;

analyze the results of the test to determine a characteristic of a subterranean formation being drilled by the drilling system; and change a composition of the drilling fluid downstream from the drilling fluid tank based on the characteristic.

7. The drilling system of claim 6, wherein the characteristic of the subterranean formation comprises at least one of a composition of the subterranean formation or a reactivity level of the subterranean formation.

8. The drilling system of claim 6, wherein the one or more processors are configured to provide an output that indicates the concentration of the component in the sample of the drilling fluid.

9. The drilling system of claim 6, wherein the capillary electrophoresis device is disposed within 100 meters of the wellbore.

10. The drilling fluid analysis system of claim 1, wherein the capillary electrophoresis device is disposed within 100 meters of the wellbore.

* * * * *